US008794158B2

(12) United States Patent
Huber et al.

(10) Patent No.: US 8,794,158 B2
(45) Date of Patent: Aug. 5, 2014

(54) MAGNETIC LEVITATION VEHICLE COMPRISING A PNEUMATIC SPRING CONTROL SYSTEM

(75) Inventors: Olaf Huber, Munich (DE); Siegbert Kunz, Miesbach (DE)

(73) Assignee: ThyssenKrupp Transrapid Gmbh, Kassel (DE)

( * ) Notice: Subject to any disclaimer, the term of this patent is extended or adjusted under 35 U.S.C. 154(b) by 2120 days.

(21) Appl. No.: 10/592,716

(22) PCT Filed: Mar. 10, 2005

(86) PCT No.: PCT/DE2005/000419

§ 371 (c)(1),
(2), (4) Date: Aug. 25, 2010

(87) PCT Pub. No.: WO2005/090137

PCT Pub. Date: Sep. 29, 2005

(65) Prior Publication Data

US 2011/0041722 A1 Feb. 24, 2011

(30) Foreign Application Priority Data

Mar. 18, 2004 (DE) ..... 10 2004 013 690

(51) Int. Cl.
*B60L 13/06* (2006.01)

(52) U.S. Cl.
USPC ..... 104/284

(58) Field of Classification Search
USPC ..... 104/281–284, 287–290
See application file for complete search history.

(56) References Cited

U.S. PATENT DOCUMENTS

| | | | | |
|---|---|---|---|---|
| 4,181,080 | A * | 1/1980 | Miller | 104/281 |
| 4,280,412 | A | 7/1981 | Mihirogi | |
| 4,698,895 | A | 10/1987 | Miller et al. | |
| 6,629,358 | B2 | 10/2003 | Setiabudi et al. | |

FOREIGN PATENT DOCUMENTS

| | | |
|---|---|---|
| DE | 22 24 635 | 11/1973 |
| DE | 27 14 282 | 10/1978 |
| DE | 29 34 169 | 3/1980 |
| DE | 39 28 277 | 12/1990 |
| GB | 1 379 059 | 1/1975 |
| WO | 97/30504 | 8/1997 |

* cited by examiner

*Primary Examiner* — R. J. McCarry, Jr
(74) *Attorney, Agent, or Firm* — Michael J. Striker

(57) ABSTRACT

A magnetic levitation vehicle is described, which comprises a car body (2), being mounted by means of pneumatic air springs (4) on a suspension frame (5), said suspension frame (5) being supported by means of supporting points (5*b*) on pairs of carrying magnets (35A, 35B). According to the invention a control device (14) is assigned to said pneumatic springs (4) in such a manner that on failure of one of the two carrying magnets (35A, 35B) the pressure in the pneumatic springs (4) can automatically be reduced to a pre-selected fraction of the nominal air pressure (FIG. 3).

10 Claims, 4 Drawing Sheets

MAGNETIC LEVITATION VEHICLE COMPRISING A PNEUMATIC SPRING CONTROL SYSTEM

Figure 1:
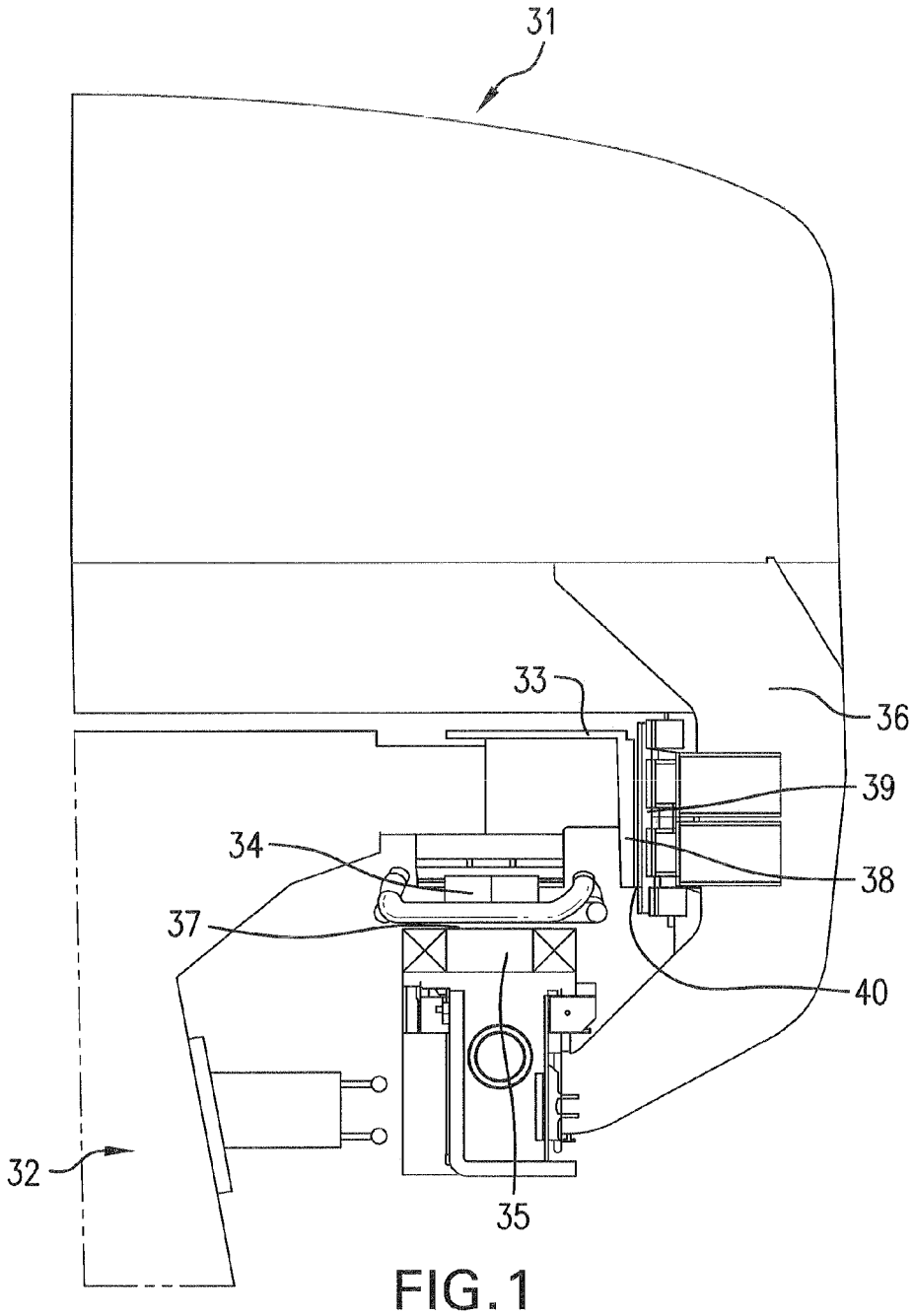

The invention relates to a magnetic levitation vehicle of the species mentioned in the preamble of Claim 1.

Known magnetic levitation vehicles of this type contain suspension frames which extend in its longitudinal direction and which on the one hand are connected to the carrying (supporting) magnets that enable a magnetic levitation and which on the other hand support the actual car body including the passenger cell via pneumatic springs. Accordingly, the pneumatic springs are operated at a pre-selected nominal air pressure of e.g. 8 bar, and are coupled with a pneumatic spring control in form of a level control which serves for controlling the air pressure during operation so that transverse inclinations of the vehicle are prevented. For reasons of redundancy, it is common practice to provide the suspension frames at those locations where the pneumatic springs are mounted, with two adjacent supporting points each formed by appropriate frame parts to support the suspension frames with these supporting points on a separate carrying magnet each. The advantage thus obtained is that the load transferred from the car body via the pneumatic springs to the suspension frames is usually taken-up by two carrying magnets at each supporting point, while in case of a failure of one of the two carrying magnets the electric current flowing through the other carrying magnet is so much increased that it also takes-up the load portion allocated to the carrying magnet which fails to work.

A disadvantage of this set-up must be seen in that the carrying magnet which has not failed to work is operated at a substantially higher electrical current than the nominal electrical current for the duration of such a failure in order to maintain the pre-determined support gap. This calls for such a strong design of the carrying magnets that they can withstand any thermal overload without any problem even in case of a longer failure. Though it would be conceivable to vent the pneumatic spring affected by such a failure, this would have the consequence that no load could be transferred from it to the pertinent pair of carrying magnets.

In view of the above, the technical problem underlying the present invention is to so design and construct the magnetic levitation vehicle of the species described hereinabove that the carrying magnet remaining operable if a failure occurs can still take-up part of the load transferred via the pneumatic spring without being overloaded, even if it is not designed for a case of failure.

The characterizing features of in Claim 1 serve to solve this problem.

The invention bears the advantage that the pressure in the pneumatic spring can be reduced in case of a failure of one of the two carrying magnets assigned to it to such a pressure as corresponds to the nominal load-bearing capacity of the non-failing carrying magnet. As the pressure in the pneumatic spring constitutes a measure for the force transferred to the carrying magnet, it is generally sufficient to reduce the usual air pressure to a half thereof. Another advantage resulting therefrom is that the load not taken-up by this carrying magnet can be distributed to several other pneumatic springs of the numerous (e.g. 16) pneumatic springs of the magnetic levitation vehicle, so that no too high loads will occur at any of the carrying magnets in case of a failure.

Other advantageous features of the present invention become evident from the subclaims.

Figure 2:
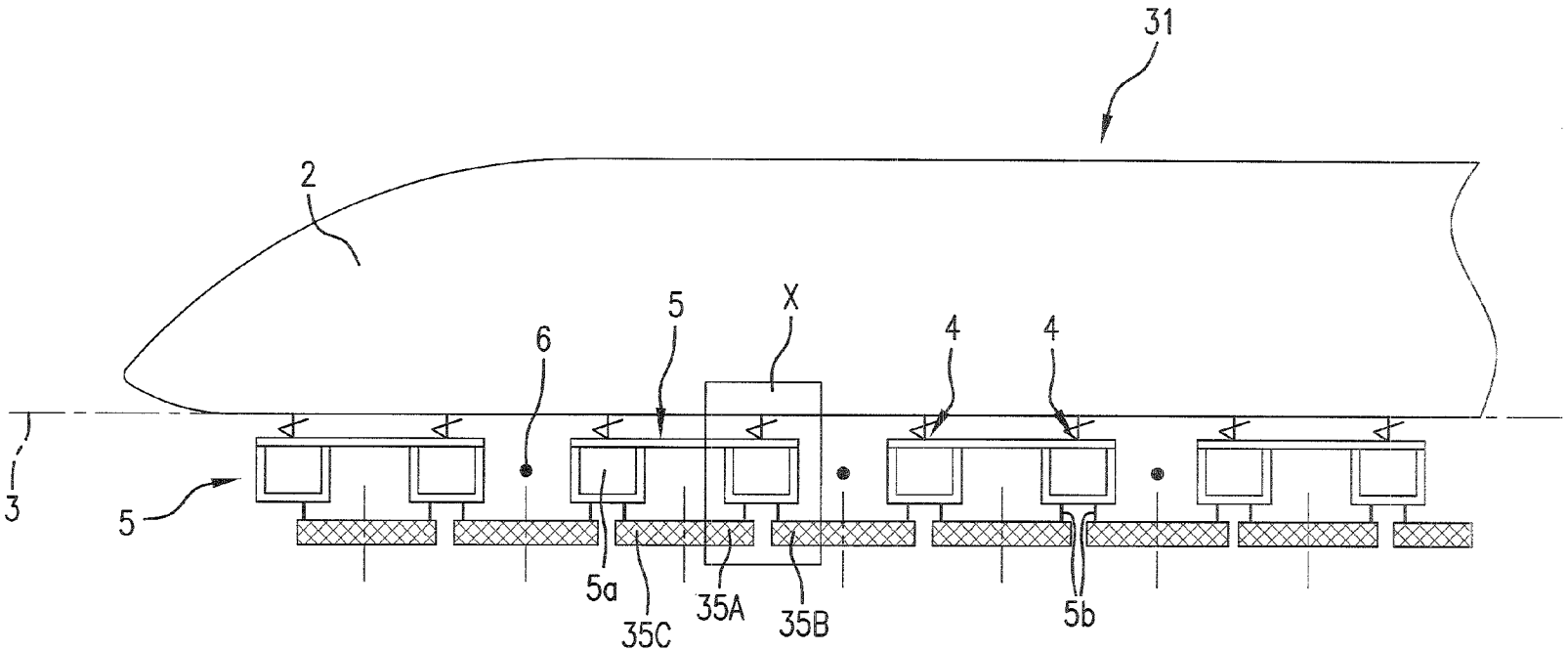
Figure 3:
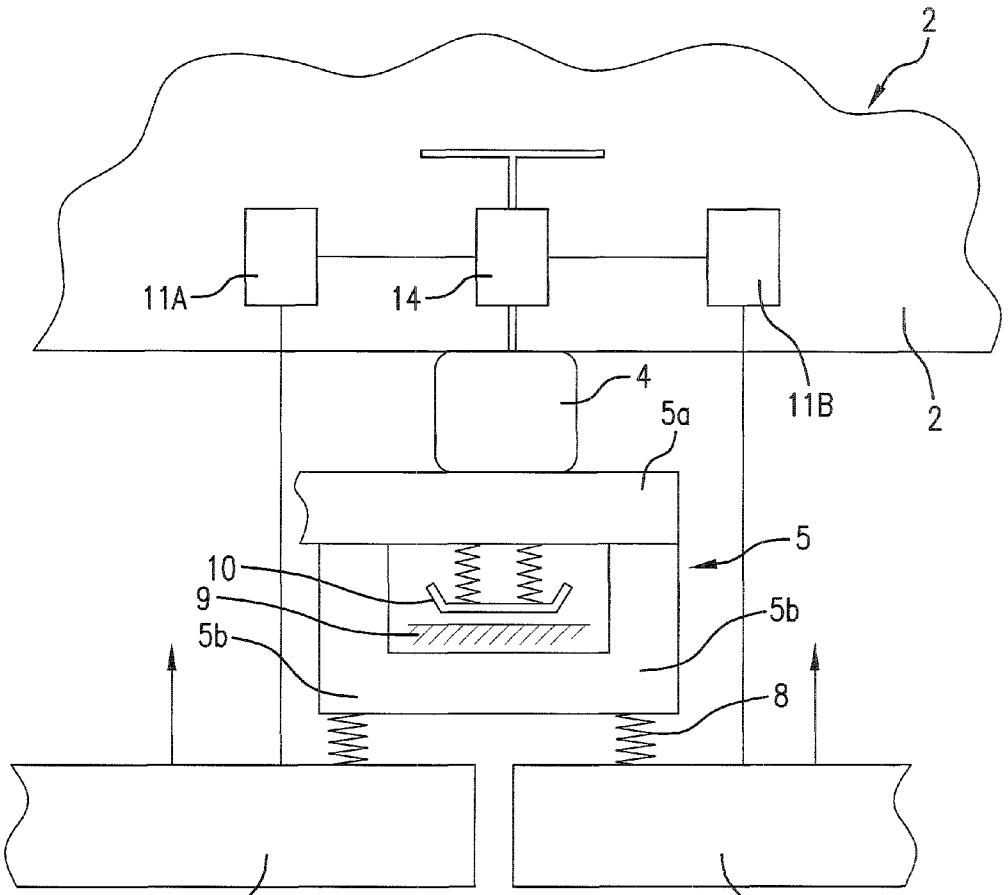
Figure 4:
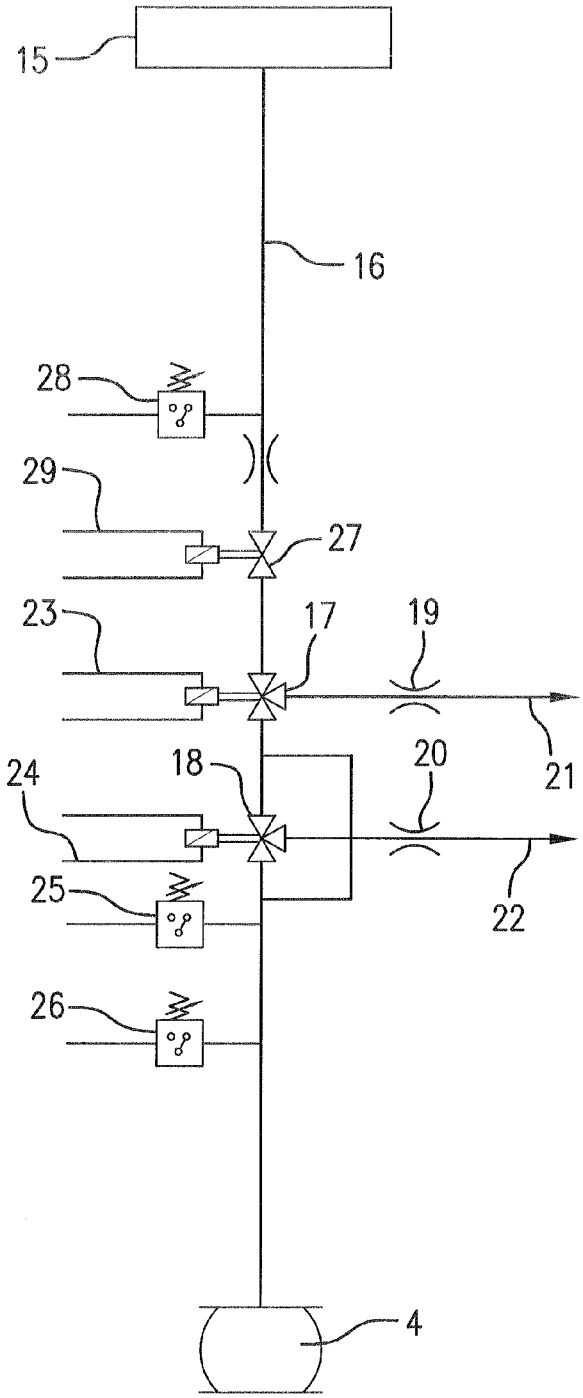

The invention is explained in greater detail below by means of an embodiment and the drawings enclosed hereto, wherein:

FIG. 1 schematically shows a partial section through a usual magnetic levitation railway and a guideway associated therewith;

FIG. 2 schematically shows a side view of a usual magnetic levitation vehicle;

FIG. 3 shows an enlarged detail X of the magnetic levitation vehicle according to FIG. 2 with further components; and FIG. 4 shows a circuit diagram of an electro-pneumatic control device for the pneumatic spring of the magnetic levitation vehicle according to FIG. 3.

FIG. 1 schematically shows a cross-section through a magnetic levitation vehicle 31 which is conventionally movably mounted on a guideway extending in longitudinal direction of a route, said guideway being comprised of supports 32 made of steel and/or concrete as well as guideway plates 33 mounted on it. The propulsion of the magnetic levitation vehicle 31 is effected, for example, by a long stator motor which comprises stator packets 34 affixed underneath said guideway plate 33 and arranged consecutively in the longitudinal direction thereof. The stator packets 34 have alternatingly succeeding teeth and grooves, not shown here, into which windings are inserted that are fed with three-phase current of a variable amplitude and frequency. The actual excitation field of the long stator motor is generated by at least one first magnet arrangement acting as carrying magnet 35 which is affixed by at least one lateral support bracket 36 to said magnetic levitation vehicle 31 and which has magnet poles facing the downwardly open grooves of stator packets 34 as shown in FIG. 1. The carrying magnet 35 not only provides the excitation field, but also fulfils the function of carrying and levitating by maintaining a given gap 37 of e.g. 10 mm between said carrying magnet 35 and said guideway or the stator packets 34 during operation of the magnetic levitation vehicle 31.

For a proper guidance of the magnetic levitation vehicle 31 on the track, the guideway plates 33 are provided with laterally affixed guide rails 38, which are faced by guiding magnets 39 also mounted to the support brackets 36 and serving for maintaining a gap 40 corresponding to gap 37 between itself and the guiding rail 38 during operation of the vehicle.

According to FIG. 2, the magnetic levitation vehicle 31 comprises a car body 2, at the underside of which several pneumatic springs 4 are mounted at a certain distance to each other in the direction of a longitudinal vehicle axis 3. One pneumatic spring 4 each acts upon the front and the rear ends of suspension frame sections 5 which form a suspension frame carrying said car body 2 and between of which hinged points 6 (joints) shown as intermediary spaces are provided which serve for enabling the suspension frame sections 5 to perform the required longitudinal and transverse movements.

At their ends, the suspension frame sections 5 are provided with supporting elements 5*a* in form of frame parts or the like which are supported on the carrying magnet 35. Each supporting element 5*a* has two supporting points 5*b* (FIG. 3) lying one behind the other in the direction of the longitudinal axis 3 and being fastened with further springs 8 to a respective carrying magnet 35. In particular, the arrangement has been so chosen that one carrying magnet 35 attacks at each supporting point 5*b* of a supporting element 5*a*, said carrying magnets being designated with 35A and 35B, respectively, in FIGS. 2 and 3. Moreover, it is possible to rigidly connect two carrying magnets (e.g. 35A and 35C in FIG. 2) with each other as indicated in FIG. 2 by hatched lines. Finally, FIG. 3 shows a gliding rail 9 which is mounted to the track 32, 33 for the magnetic levitation vehicle 31 and on which said magnetic levitation vehicle 31 shown in FIG. 1 is set down by means of gliding skids 10 fastened to the suspension frame sections 5 when the carrying magnets 35 have been de-energized and therefore cannot serve the function of "carrying".

Assigned to each carrying magnet 35A, 35B is a control circuit 11A, 11B which serves for giving a size of e.g. 10 mm to the support gap 37 arranged between said track 2, 3 or its stator packets 34 and the assigned poles of the carrying magnets 35, said support gap establishing the suspended status of the magnetic levitation vehicle 31. The movement of the magnetic levitation vehicle 31 in the direction of the longitudinal axis 3, for example, is initiated by the long stator linear motor described on FIG. 1.

Magnetic levitation vehicles 31 and their magnet arrangements are generally known to an expert, e.g. through printed publications U.S. Pat. No. 4,698,895, DE 30 04 704 C2, DE 39 28 277 A1, and PCT WO 97/30504 A1, which for the sake of simplicity are made a part of the present disclosure by reference.

Assigned to the pneumatic spring 4 is a control device 14 according to the present invention which serves the function being described by means of FIG. 4 hereinafter and which is coupled to those two control circuits 11A, 11B that act onto the two support points 5B of the suspension frame section 5 assigned to the pneumatic spring 4.

According to FIG. 4, the control device 14 comprises a compressed air source 15 which for example may be a compressor or a level control unit not being of any interest here and which is connected via a line 16 to said pneumatic spring 4. Integrated into the line 16 between the compressed air source 15 and the pneumatic spring 4 are two control valves 17 and 18, both of which lead via a throttle 19, 20 each to a vent line 21, 22 or to the atmosphere outside. Both control valves 17 and 18 are at least controllable via control lines 23, 24 in a way that in a first position they switch the line 16 to allow the passage of the compressed air, but provide a shutoff against the vent lines 21, 22, or that in a second position they at least connect the line 16 on the side of the pneumatic spring 4 to the vent line 21, 22. Furthermore, two pressure switches 25, 26 are assigned to the line 16 which monitor the air pressure in the line 16 and which transmit a switching signal when a pre-selected air pressure is reached. Accordingly, both pressure switches 25 and 26 are connected both to the control circuit 11A and to control circuit 11B. Finally, a control valve 27 is also integrated into the line 16 which serves for ventilation, to which a pressure switch 28 also integrated in the line 16 is associated and which can via a control line 29 either be switched to allow the passage of the compressed air or shut-off the line 16. Other components not being important for the present invention are not illustrated or shown here for the sake of simplicity.

The operation of the described control device 14 according to FIG. 4 is as follows:

Before taking the magnetic levitation vehicle 1 into operation, the pneumatic spring 4 is adjusted and set via line 16 to a pre-selected nominal air pressure after having opened the control valve 27 and switched the control valves 17, 18 to allow the passage of the compressed air. When this nominal pressure has been reached, which is signalized by the pressure switch 28, the control valve 27 is closed again. The magnetic levitation vehicle can be taken into operation now. If, for example, if the load-bearing capacity of the carrying magnet 35A at the suspension frame section 5 fails to work, the carrying magnet 35B usually receives twice the load-bearing capacity as compared with the status existing before said failure by increasing the electrical current through its winding by means of the pertinent control circuit 11B not shown here. In contrast therewith, an automatic venting of the pneumatic spring 4 to a pre-selected fraction of the nominal air pressure (e.g. from an original value of 8 bar to just 3.5 bar), delivered by the compressed air source 15 and/or previously established in the pneumatic spring 4, is effected in this situation according to the present invention in order to restore the original load-bearing capacity of the carrying magnet 35B and/or to adjust the partial load transferred via the air spring 4 to the carrying magnet 35B to a value that corresponds to the load-bearing capacity of the carrying magnet 35B at its nominal electrical current. For this purpose, the control valve 17 is brought via the control line 23 into a position in which the line 16 is connected via the throttle 19 to the vent line 21 so that the air from the pneumatic spring 4 escapes through this path. The control valve 17 is controlled by the aid of a fault signal which is fed to the control device 14 from the control circuit 11A of the carrying magnet 35A which has failed to work and/or which is generated, for example, when the carrying magnet 35A has been de-energized or if there is any other fault.

Venting of the pneumatic spring 4 is continued until the respective pressure switch 25 indicates that only a fraction of the original air pressure exists in the line 16 between the closed control valve 27 and the pneumatic spring 4 and thus also in the pneumatic spring 4 itself. Next, the control valve 17 is again switched via control line 23 to free passage, thus isolating the line 16 from the venting line 21. Now the pneumatic spring 4 is operated at a pressure which is reduced as compared with the nominal air pressure. As this value is preferably so chosen that the load now transferred via the pneumatic spring 4 substantially corresponds to the load-bearing capacity of the carrying magnet 35B which said magnet provides at the nominal electrical current, the portion of the load which is then not assigned to the carrying magnet 35B is preferably distributed as evenly as possible to the remaining carrying magnets 35 of the magnetic levitation vehicle 1 (FIG. 1). Overloading the carrying magnets 35 is thereby largely avoided.

To avoid that no venting of the pneumatic spring 4 is provided when the control device 14 described hereinabove fails to work, especially, for example, due to a defect of the control valve 17, throttle 21, or the like, a redundant device is provided for according to the present invention which device comprises the component parts 18, 20, 22, 24, and 26. This device works as follows:

If a venting of the pneumatic spring 4 does not occur due to the described faulty functions, the electrical current through the winding of the non-failing carrying magnet 35B is automatically increased by the control circuit 11B beyond the nominal electrical current. In the control circuit 11B, this leads to a corresponding increase, for example at the output of the actuator element concerned. The control circuits 11A, 11B, therefore, are additionally provided with limit value monitoring devices in the form of threshold value switches or the like, which when a pre-selected limit value, particularly with regard to the electrical current in the winding of the carrying magnet 35B is reached and/or exceeded, move the control valve 18 via the control line 24 of FIG. 4 into a position in which it connects the line 16 with the vent line 22. Thereby, the pneumatic spring 4 is vented analogously to the description given hereinabove until the assigned pressure switch 26 in turn indicates that the desired lower air pressure has been reached and automatically isolates the control valve 18 from the venting line 22. Thus, via the described redundant path, the same result as the one obtained by the aid of the control valve 17 is achieved.

If the pressure in line 16 is to be increased again to the nominal air pressure, this can be accomplished by actuating the control valve 27 which then connects the compressed air source 15 with the pneumatic spring 4 until it has attained the desired nominal air pressure. Subsequently, the control valve 27 is closed again.

A similar approach is made when the carrying magnet 35B instead of carrying magnet 35A fails to work.

The invention is not limited to the described embodiment that can be diversified in a plurality of ways. In particular, this applies to the described distribution of load in the area of the suspension frame sections 5 and/or supporting elements 5*a*. This distribution of load, in particular, can also be provided for analogously at both longitudinal sides of the magnetic levitation vehicle 1 if it is equipped with the appropriate carrying magnets for this purpose at right and left. The decision on how to provide the distribution of loads to the carrying magnets 35 by the aid of the pneumatic springs 4 in principle can be taken depending on the individual requirements of a given case. The air pressures indicated hereinabove as examples can also be replaced with other pressure rates. Furthermore, the configuration of the control device 14 can be effected in a manner different from the one shown in FIG. 4, particularly by controlling the various control procedures by the aid of microprocessors or the like. Moreover it is obvious that all the pneumatic springs 4 existing in the magnetic levitation vehicle 1 can be controlled in a corresponding manner and way. Finally, it is self-explanatory that the different features can also be applied in combinations other than those described and shown hereinabove.

The invention claimed is:

1. A magnetic levitation vehicle comprising:

a car body (2), a plurality of suspension frame sections (5) arranged so that the sections, while not directly coupled with each other, form an extension frame extending in parallel to a longitudinal vehicle axis (3), wherein said extension frame sections (5) include ends comprising supporting elements (5*a*) and wherein each supporting element (5*a*) comprises two adjacent supporting points (5*b*) that are arranged one behind the other in a direction of the longitudinal axis (3), a number of carrying magnets (35) arranged one behind the other in the direction of said longitudinal axis (3) that act in pairs (35A, 35B) on said adjacent supporting points (5*b*), and at least one controllable pneumatic spring (4) arranged in the area of adjacent supporting points (5*b*) that operates at a pre-selected nominal air pressure, said spring (4) supporting the car body (2) on the suspension frame, wherein a control device (14) is assigned to said pneumatic spring (4) and is activated in response to a fault signal generated on failure of one of the two carrying magnets (35A, 35B) and wherein in response to said activation the control device automatically controls the pressure in the pneumatic spring (4) to be reduced to a pre-selected fraction of the nominal air pressure.

2. A magnetic levitation vehicle according to claim 1, characterised in that the fault signal is generated by the control circuit (e.g. 11A) of the carrying magnet (e.g. 35A) that fails to work.

3. A magnetic levitation vehicle according to claim 1, characterised in that the fault signal is generated by the control circuit (e.g. 11B) of the carrying magnet (e.g. 35B) that does not fail to work.

4. A magnetic levitation vehicle according to claim 1, characterised in that the control device (14) comprises a first control valve (17) through which the pneumatic spring (4) is vented until the pre-selected fraction of the nominal air pressure is reached.

5. A magnetic levitation vehicle according to claim 4, characterised in that the control of the first control valve (17) is effected by the fault signal of the carrying magnet (e.g. 35A) that fails to work.

6. A magnetic levitation vehicle according to claim 4, characterised in that the control of the second control valve (18) is effected by the fault signal of the carrying magnet (e.g. 35B) that does not fail to work.

7. A magnetic levitation vehicle according to claim 1, characterised in that the control device (14) comprises a second control valve (18) through which the pneumatic spring (4) is vented until the pre-selected fraction of the nominal air pressure is reached.

8. A magnetic levitation vehicle according to claim 1, characterised in that the fraction of the nominal air pressure is chosen so that the force exerted by the car body (2) on the carrying magnet (e.g. 35B) that has not failed to work is substantially reduced to a half.

9. A magnetic levitation vehicle according to claim 8, characterised in that the pre-selected fraction roughly corresponds to half the nominal air pressure.

10. A magnetic levitation vehicle according to claim 1, characterised in that the fault signal is generated depending on the electrical currents fed to the windings of the carrying magnets (35A, 35B).

* * * * *